United States Patent [19]

Sklar

[11] 4,429,427

[45] Feb. 7, 1984

[54] SEATING CUSHION

[75] Inventor: Joseph Sklar, Toronto, Canada

[73] Assignee: Sklar-Peppler Inc., Whitby, Canada

[21] Appl. No.: 369,462

[22] Filed: Apr. 19, 1982

[51] Int. Cl.[3] ..... A47C 27/20; A47C 27/05; A47C 27/07

[52] U.S. Cl. ..... 5/474; 5/475; 5/481

[58] Field of Search ..... 5/481, 475, 477, 478, 5/474

[56] References Cited

U.S. PATENT DOCUMENTS

| | | | |
|---|---|---|---|
| 3,099,021 | 7/1963 | Wetzler | 5/477 |
| 3,310,819 | 3/1967 | Morrison | 5/481 |
| 3,401,411 | 9/1968 | Morrison | 5/481 |

FOREIGN PATENT DOCUMENTS

| | | | |
|---|---|---|---|
| 1422984 | 11/1965 | France | 5/481 |

*Primary Examiner*—Alexander Grosz
*Attorney, Agent, or Firm*—Fetherstonhaugh & Co.

[57] ABSTRACT

A seat cushion which comprises a main body portion and a pair of facing panels is formed with a plurality of spring mounting passages opening through the main body portion. The spring mounting passages include perimeter passages located about the perimeter of the seating area and inboard passages located inwardly of the perimeter passages. Perimeter compression springs are located in the perimeter passages and inboard compression springs are located in the inboard passages. Resiliently flexible retainer wires extend about the perimeter of the seating area and are secured and held fast with respect to the perimeter springs while being free of attachment to the inboard springs.

2 Claims, 4 Drawing Figures

SEATING CUSHION

FIELD OF INVENTION

Figure 1:
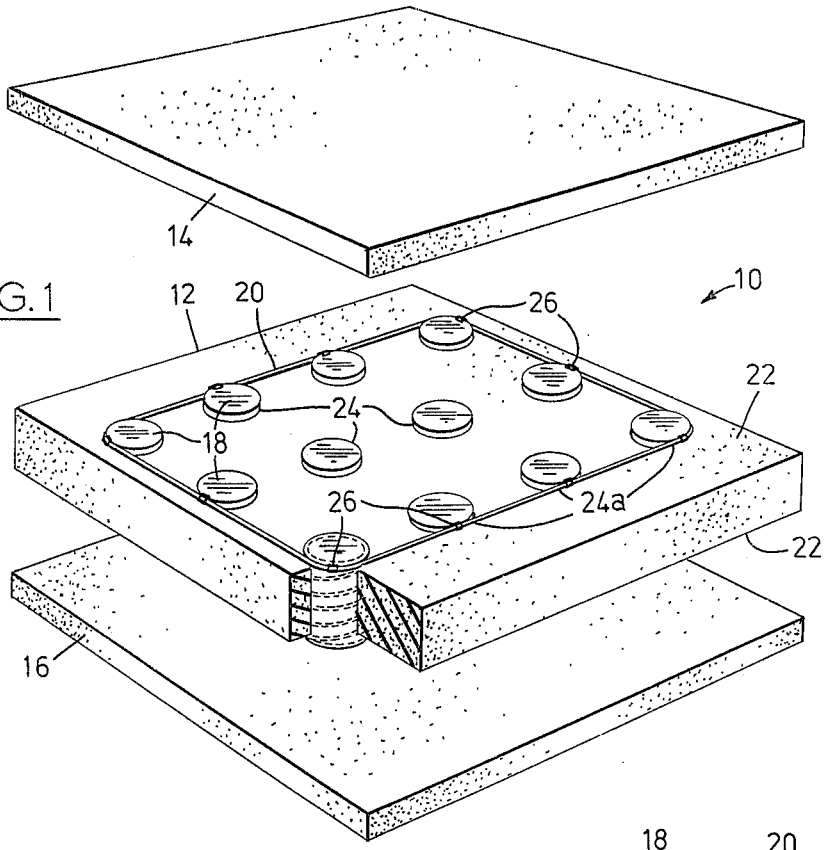

This invention relates to seating cushions. In particular, this invention relates to spring reinforced seating cushions.

PRIOR ART

Previous proposals have included the positioning of pocket springs in the body of the foam material. The foam material which forms the wall of the passages within which the springs are mounted is subjected to substantial loads due to relative movement between the spring members and the foam and these loads tend to break down the structure of the foam material in these areas. As a result passages within which the springs are located become enlarged through use.

The loading of the seat area is such that when loaded the springs must be deflected from a truly vertical orientation to follow the curvature which the seating area must assume when loading. As a result of the wear which occurs in the wall of the passages surrounding the pocket springs in the body of foam material, the coil springs can become misaligned with the result that the seating comfort may be drastically impaired. An important characteristic of the seating comfort of spring reinforced foam cushions is that the user should not be able to detect the presence of individual pocket springs. Spring misalignment can however create an uneven spring reinforcing, in fact which can be detected by the user.

The above difficulties can be overcome by providing a resiliently flexible retaining member which is secured to and held fast with respect to one end of each of the springs which are located in the spring passages which are located about the perimeter of the seating area.

It is an object of the present invention to provide a simple an inexpensive mechanism for maintaining the alignment of the springs which are located at the perimeter of the seating area of a spring reinforced foam cushion

SUMMARY OF THE INVENTION

A seat cushion comprising a main body panel of a cushion type foam material having a pair of oppositely disposed seating faces, a plurality of spring mounting passages opening through said main body in a seating area thereof, said passages extending perpendicularly between said seating faces, said passages including perimeter passages located along the perimeter of the seating area, and inboard passages located inwardly from the perimeter of the seating area, a plurality of perimeter compression springs mounted one within each of said perimeter passages and a plurality of inboard compression springs mounted one within each inboard passage, a resiliently flexible retainer member extending about the perimeter of said seating area, along one of said seating faces, said retaining member being secured to and held fast and taut with respect to one end of each perimeter spring which is located in each perimeter whereby upon the removal of a seating load, the retaining member will restore the perimeter compression springs to the perpendicular position, said resiliently flexible retainer member being free of attachment to the inboard springs whereby the inboard spring are independently compressible, and, a pair of facing panels, one said facing panels being disposed in a face-to-face relationship with respect to each seating face of said main body panel.

PREFERRED EMBODIMENT

The invention will be more clearly understood with reference to the following detailed specification read in conjunction with the drawings wherein, FIG. 1 is an exploded partially sectioned view of the spring reinforced spring foam cushion constructed in accordance with an embodiment of the present invention.

Figure 2:
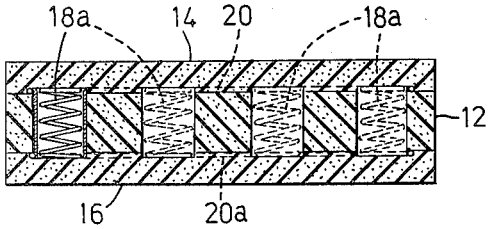
Figure 3:
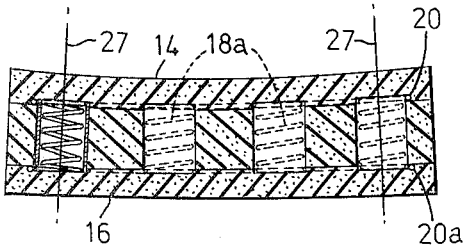
Figure 4:
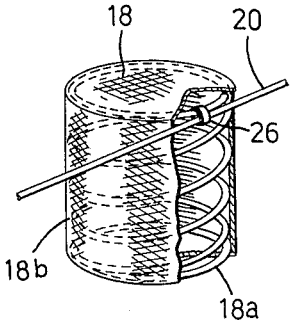

FIG. 2 is a sectional view of the cushion of FIG. 1 in a relaxed configuration, FIG. 3 is a sectional view similar to FIG. 2 showing the loaded configuration of the cushion, FIG. 4 is a partially sectioned pictorial view of a spring connected to a resiliently flexible retaining member.

With reference to FIG. 1 of the drawings, the reference numeral 10 refers generally to a cushion constructed in accordance with an embodiment of the present invention. The cushion 10 comprises a main body portion 12, an upper facing panel 14, a lower facing panel 16, a plurality of pocket springs 18 and a thin resiliently flexible retaining member 20.

The main body portion 12 has oppositely disposed seating faces 22. Cylindrical shaped passages 24 extend through the main body 12 and are opened at the seating faces 22. The passages 24 are spaced a substantial distance from one another and in the embodiment illustrated in FIG. 1, they are uniformly spaced with respect to one another and include passages **24*a*** which extend about the perimeter of the seating area of the cushion.

Each of the pocket springs 18 comprises a coil spring member **18*a* which is enclosed in a fabric cover 18*b*. The end turn of the coil spring 18*a* is secured and held fast with respect to the resilient retainer member 20 by means of a collar 26** which encircles the end coil and the retaining member and is crimped to achieve a fast connection therebetween.

The main body panel 12 and facing panels 14 and 16 may be made from any conventional foam cushion material. The outer springs 18 may be original pocket springs of the type used in the fabrication of spring cushions. The resiliently flexible retaining member 20 may be in the form of a thin gauge resiliently flexible wire member which may be preshaped to a configuration to a lesser extent about the perimeter of the seating areas tangential to the perimeter of the springs which are located about the perimeter of the seating area.

As shown in the embodiments illustrated in FIG. 1, a single retaining member secured at one end of the coil springs may be sufficient to obtain the required realignment of the springs. In the alternative embodiment illustrated in FIGS. 2 and 3 of the drawings, a second retaining member **20*a* is located so as to extend about the perimeter of the opposite ends of the pocket springs 18. The second retaining member 20 is secured to the perimeter springs in the same manner as the first retaining member as shown in FIG. 4** of the drawings.

As shown in FIG. 3 of the drawings, when the seating area is loaded, the axes 27 of the springs which are located at the perimeter area are deflected so as to be upwardly converging when the seat is loaded. When the load is removed, the resilient retaining members 20 and **20*a* serve to return the springs to the vertical orientation illustrated in FIG. 2. This ensures that when the foam material breaks down in the walls surrounding the spring mounting passages, the springs will be retained in their required upright configuration and returned to the required upright configuration by the resiliently flexible retaining members 20 and 20***a*.

From the foregoing, it will be apparent that the present invention provides a simple and inexpensive mechanism which will serve to lengthen the useful life of a spring reinforced foam cushion.

What I claim is:

1. A seat cushion comprising:

(a) a main body panel of cushion type foam material having a pair of oppositely disposed seating faces, a plurality of spring mounting passages opening through said main body in a seating area thereof, said passages extending perpendicularly between said seating faces, said passages including perimeter passages located along the perimeter of the seating area, and inboard passages located inwardly from the perimeter of the seating area, (b) a plurality of perimeter compression springs mounted one within each of said perimeter passages and a plurality of inboard compressions springs mounted one within each inboard passage, (c) a resiliently flexible retainer member extending about the perimeter of said seating area, along one of said seating faces, said retaining member being secured to and held fast and taut with respect to one end of each perimeter spring which is located in each perimeter passage whereby upon the removal of a seating load, the retaining member will restore the perimeter compression springs to the perpendicular position, said resiliently flexible retainer member being free of attachment to the inboard springs whereby the inboard springs are independently compressible, and, (d) a pair of facing panels, on said facing panels being disposed in a face-to-face relationship with respect to each seating face of said main body panel.

2. A seating cushion as claimed in claim 1 further comprising a second resiliently flexible retaining member extending about the perimeter of the seating area along a second of said seating faces, said second retaining member being secured to and held fast and taut with respect to the other end of each perimeter spring which is located in a perimeter passage, said second flexible retainer being free of attachment to the inboard springs whereby the inboard springs are independently compressible.

* * * * *